US008928244B2

(12) United States Patent
Kikuchi et al.

(10) Patent No.: US 8,928,244 B2
(45) Date of Patent: Jan. 6, 2015

(54) SEMICONDUCTOR LIGHT SOURCE LIGHTING CIRCUIT

(75) Inventors: Satoshi Kikuchi, Shizuoka (JP); Fuminori Shiotsu, Shizuoka (JP); Takanori Namba, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 160 days.

(21) Appl. No.: 13/467,229

(22) Filed: May 9, 2012

(65) Prior Publication Data

US 2012/0286687 A1 Nov. 15, 2012

(30) Foreign Application Priority Data

May 12, 2011 (JP) ..... 2011-107177

(51) Int. Cl.
*H05B 37/02* (2006.01)
*H05B 33/08* (2006.01)

(52) U.S. Cl.
CPC ..... *H05B 33/0851* (2013.01)
USPC ..... 315/291; 315/294; 315/308

(58) Field of Classification Search
USPC ..... 315/80, 82, 291, 307–308, 185 R, 193, 315/294, 297
See application file for complete search history.

(56) References Cited

U.S. PATENT DOCUMENTS

2009/0160422 A1* 6/2009 Isobe et al. ..... 323/349

FOREIGN PATENT DOCUMENTS

JP 2010-170704 A 8/2010

* cited by examiner

*Primary Examiner* — Tuyet Thi Vo
*Assistant Examiner* — Henry Luong
(74) *Attorney, Agent, or Firm* — Sughrue Mion, PLLC

(57) ABSTRACT

A semiconductor light source lighting circuit includes a switching regulator that produces a drive current $I_{LED}$ with a switching element, and a control circuit that controls turning on and off of the switching element so that the magnitude of the drive current $I_{LED}$ approaches a target value. The control circuit includes an error comparator that compares the drive current $I_{LED}$ and the target value, an up/down counter that performs a counting operation, in which the control digital value is incremented or decremented based on the result of the comparison, a D/A converter that converts the control digital value into an analog duty ratio setting signal S4, and a drive circuit that controls the turning on and off of the switching element based on the signal S4. The up/down counter stops the counting operation when the switching regulator is brought into the inactive state.

2 Claims, 6 Drawing Sheets

SEMICONDUCTOR LIGHT SOURCE LIGHTING CIRCUIT

INCORPORATION BY REFERENCE

The disclosure of Japanese Patent Application No. 2011-107177 filed on May 12, 2011 including the specification, drawings and abstract is incorporated herein by reference in its entirety.

BACKGROUND OF THE INVENTION

1. Field of the Invention

The present invention relates to a semiconductor light source lighting circuit that lights a semiconductor light source such as a light emitting diode (LED) or the like.

2. Description of Related Art

In recent years, vehicular lamps, such as headlamps and the like, use LEDs that are long in service life and low in power consumption, instead of conventional halogen lamps that have filaments. The degree of light emission of an LED, that is, the brightness thereof, depends on the magnitude of electric current that flows through the LED. Therefore, when an LED is to be used as a light source, it is necessary to provide a lighting circuit for adjusting the current that flows through the LED. Such a lighting circuit usually has an error amplifier and performs a feedback control such that the current that flows through the LED becomes constant.

It is desirable that the brightness of an LED be adjustable because, for example, there are a high-beam state and a low-beam state of a headlamp, and also in order to make it easy to meet standard requirements. Available methods for changing the brightness of an LED include a method in which the value of electric current is continuously changed and a pulse width modulation (PWM) light dimming method in which current is switched on and off to change the duty ratio. In the former method, a color shift in which the color tone or the color temperature changes depending on the value of current can occur. Therefore, the LED lighting circuits of vehicular lamps often adopt the PWM light dimming method.

In Japanese Patent Application Publication No. 2010-170704 (JP 2010-170704 A), assigned to the same assignee as the assignee of the present application, a lighting control apparatus that adopts the PWM light dimming method has been proposed.

In the lighting control apparatus described in JP 2010-170704 A, the value of LED current detected during a period in which a switching regulator is driven is retained in an analog manner by using capacitors during a stop period that follows the elapse of that driving period. However, generally, the capacitors provided for maintaining the value of current in an analog manner have relatively large capacity. Therefore, there is a possibility of the size of the circuit becoming unnecessarily or inconveniently large

SUMMARY OF THE INVENTION

The present invention provides a semiconductor light source lighting circuit that allows reduction of the circuit size while realizing the PWM light dimming.

One aspect of the present invention is a semiconductor light source lighting circuit. This semiconductor light source lighting circuit includes: a switching regulator that has a switching element and produces a drive current for driving the semiconductor light source by using the switching element; and a control circuit that is configured to control turning on and off of the switching element so that magnitude of the drive current approaches a target value. The control circuit includes: a comparator that compares the magnitude of the drive current and the target value; an up/down counter that is configured to perform a counting operation, in which a digital value is incremented or decremented based on a result of comparison performed by the comparator and that is configured to stop the counting operation when the switching regulator is brought into an inactive state in which the drive current is not produced; a digital/analog converter that converts the digital value into an analog signal; and a drive circuit that is configured to control the turning on and off of the switching element based on the analog signal.

According to this aspect, the control circuit is able to digitally retain the magnitude of the drive current during the inactive state of the switching regulator.

According to the present invention, it is possible to reduce the circuit size while realizing the PWM light dimming.

BRIEF DESCRIPTION OF THE DRAWINGS

Features, advantages, and technical and industrial significance of exemplary embodiments of the present invention will be described below with reference to the accompanying drawings, in which like numerals denote like elements, and wherein.

DETAILED DESCRIPTION OF EMBODIMENTS

Figure 1:
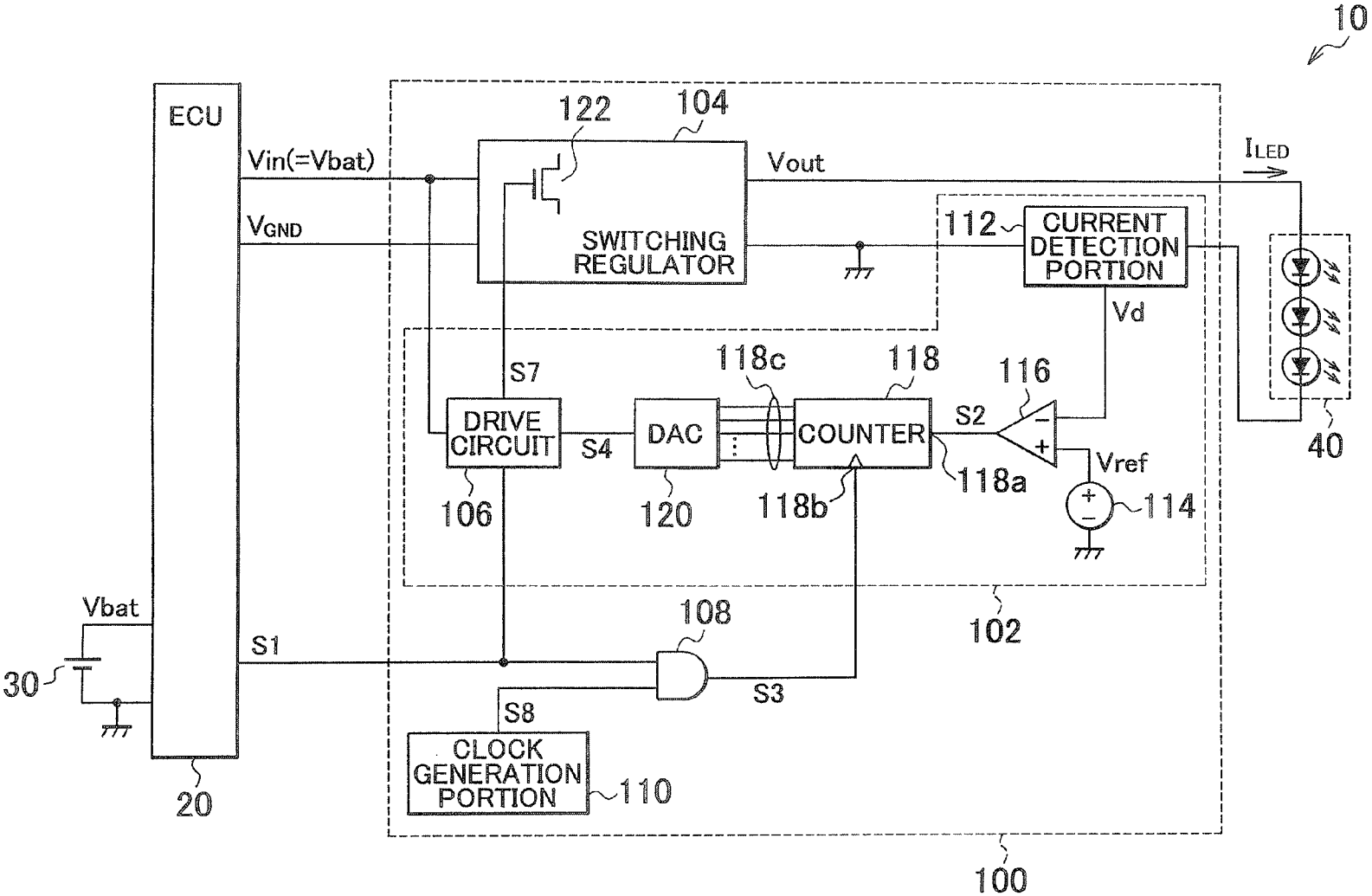
FIG. 1 is a circuit diagram showing a construction of a vehicle-mounted circuit in accordance with a first embodiment of the present invention.

The same or comparable component elements, members, and signals shown in the drawings are denoted by the same reference characters, and redundant descriptions thereof will be omitted below as appropriate. Besides, in the drawings, one or more members that are not important for descriptive purposes are omitted from illustration. The reference characters used to denote voltage, current or resistance are sometimes used to represent values of voltage, current or resistance according to need.

In this specification, a "state in which a member A is connected to a member B" includes not only the case where the member A and the member B are physically directly connected to each other but also the case where the member A and the member B are indirectly connected to each other via another electrically conductive member. Likewise, a "state in which a member C is provided between a member A and a member B" includes not only the case where the member A and the member C or the member B and the member C are directly connected to each other but also the case where the member A and the member C or the member B and the member C are indirectly connected via another electrically conductive member.

(First Embodiment)

A semiconductor light source lighting circuit in accordance with a first embodiment of the present invention includes a switching regulator that produces a drive current that flows through a light emitting diode (LED) by using a switching element, and a control circuit that performs feedback control of turning on and off of the switching element so that the magnitude of the drive current approaches a target value. Furthermore, the semiconductor light source lighting circuit performs pulse width modulation (PWM) light dimming. Specifically, the degree of light emission from the LED is adjusted by the switching regulator repeatedly switching between an active state in which drive current is produced and an inactive state in which drive current is not produced. It is to be noted herein that control values, such as an error amount in the feedback control, and the like, are digitally retained from when the switching regulator is brought into the active state to when the switching regulator is subsequently brought into the active state. This makes it possible to omit capacitors for retaining a state or the like and reduce the circuit size in comparison with the case where the control value is retained in an analog manner as described in, for example, Japanese Patent Application Publication No. 2010-170704 (JP 2010-170704 A).

FIG. 1 is a circuit diagram showing a construction of a vehicle-mounted circuit 10. The vehicle-mounted circuit 10 includes a semiconductor light source lighting circuit 100 in accordance with the first embodiment, an engine control unit (ECU) 20, a vehicle-mounted battery 30, an LED 40 constructed by connecting three LEDs for onboard use in series.

The engine control unit 20 is a micro controller for comprehensively performing electrical controls of a motor vehicle in which the engine control unit 20 is mounted. The engine control unit 20 is connected to the vehicle-mounted battery 30, and receives a battery voltage Vbat of about 12 V from the vehicle-mounted battery 30. The engine control unit 20 supplies the semiconductor light source lighting circuit 100 with the direct current (DC) battery voltage Vbat as an input voltage Vin. The engine control unit 20 supplies the semiconductor light source lighting circuit 100 with a fixed voltage, that is, a ground potential $V_{GND}$ (=0 V). The engine control unit 20 generates a PWM (Pulse Width Modulation) light dimming signal S1, and supplies the signal S1 to the semiconductor light source lighting circuit 100.

The PWM light dimming signal S1 is a signal for blinking the LED 40 at high rate, for example, at a frequency of several hundred Hz to several kHz, in order to avoid the color shift. More concretely, the PWM light dimming signal S1 is a signal whose voltage changes in a rectangular waveform at a light dimming frequency f1 of several hundred Hz to several kHz. The duty ratio of the PWM light dimming signal S1 is set so that a desired degree of light emission is obtained.

The semiconductor light source lighting circuit 100 includes a control circuit 102, a switching regulator 104, a first AND gate 108, and a clock generation portion 110. The switching regulator 104 converts the input voltage Vin input from the engine control unit 20 into an output voltage Vout suitable for a forward voltage Vf of the LED 40 and therefore produces a drive current $I_{LED}$ that flows through the LED 40, by using a switching element 122 that may be a transistor such as a MOSFET (Metal Oxide Semiconductor Field Effect Transistor). The switching regulator 104 applies the output voltage Vout to an anode of the LED 40. The ground potential of the switching regulator 104 is supplied from the engine control unit 20. Switching regulator 104 repeatedly switches between the active state and the inactive state according to the PWM light dimming signal S1 as described below.

The control circuit 102 controls the turning on and off of the switching element 122 so that the magnitude of the drive current $I_{LED}$ approaches a target value. The control circuit 102 includes a current detection portion 112, a reference voltage source 114, an error comparator 116, an up/down counter 118, a D/A converter 120, and a drive circuit 106.

The current detection portion 112 detects the magnitude of the drive current $I_{LED}$. The current detection portion 112 is, for example, a current detecting resistor through which the drive current $I_{LED}$ flows, and produces a detection voltage Vd commensurate with the magnitude of the drive current $I_{LED}$, and applies it to the inverting input terminal of an error comparator 116. The detection voltage Vd is produced with reference to a fixed voltage such as a ground potential or the like.

The reference voltage source 114 produces a reference voltage Vref that corresponds to a target value of the magnitude of the drive current $I_{LED}$, and applies the reference voltage Vref to a non-inverting input terminal of the error comparator 116. The reference voltage Vref is produced with reference to a fixed voltage.

The error comparator 116 compares the detection voltage Vd and the reference voltage Vref. That is, the error comparator 116 compares the magnitude of the drive current $I_{LED}$ represented by the detection voltage Vd and the target value represented by the reference voltage Vref. The error comparator 116 outputs to the up/down counter 118 an error signal S2 whose voltage level changes depending on the magnitude relation between the detection voltage Vd and the reference voltage Vref. In particular, the voltage of the error signal S2 becomes equal to a predetermined first voltage, for example, 5 V or the like, when Vd<Vref, and becomes equal to a second voltage, such as 0 V or the like, which is lower than the first voltage, when Vd≤Vref.

The up/down counter 118 performs a counting operation, in which a control digital value is incremented or decremented based on a result of the comparison performed by the error comparator 116. It suffices that the up/down counter 118 has a function of performing the counting operation and retaining the digital value as described above and therefore, an element that has substantially the same functions as a 74-series '191, which is a standard logic IC, may be used as the up/down counter 118. The up/down counter 118 has a U/D control terminal 118*a* to which the error signal S2 is input, a clock pulse input terminal 118*b* to which a post-process clock signal S3 is input, and output terminals 118*c*, the number of which corresponds to the number of bits of the control digital value to be incremented and decremented.

While the error signal S2 exhibits the first voltage, the up/down counter 118 increments the control digital value at the time of the transition of the post-process clock signal S3, that is, every time a rising edge appears in the post-process clock signal S3. While the error signal S2 exhibits the second voltage, the up/down counter 118 decrements the control digital value every time a rising edge appears in the post-process clock signal S3. The up/down counter 118 outputs the present control digital value from the output terminal 118*c* to the digital-analogue (D/A) converter 120.

The D/A converter 120 converts the control digital value incremented and/or decremented by the up/down counter 118 into a duty ratio setting signal S4 that has an analog voltage commensurate with the control digital value. The digital/analog conversion process in the D/A converter 120 may be performed by using a known digital/analog conversion technique. The D/A converter 120 outputs the duty ratio setting signal S4 to the drive circuit 106.

The drive circuit 106 controls the on-off duty ratio of the switching element 122 on the basis of the duty ratio setting signal S4 obtained as a result of the conversion performed by the D/A converter 120. The PWM light dimming signal S1 is input to the drive circuit 106. The drive circuit 106 sets the input voltage Vin as a power source voltage.

Figure 2:
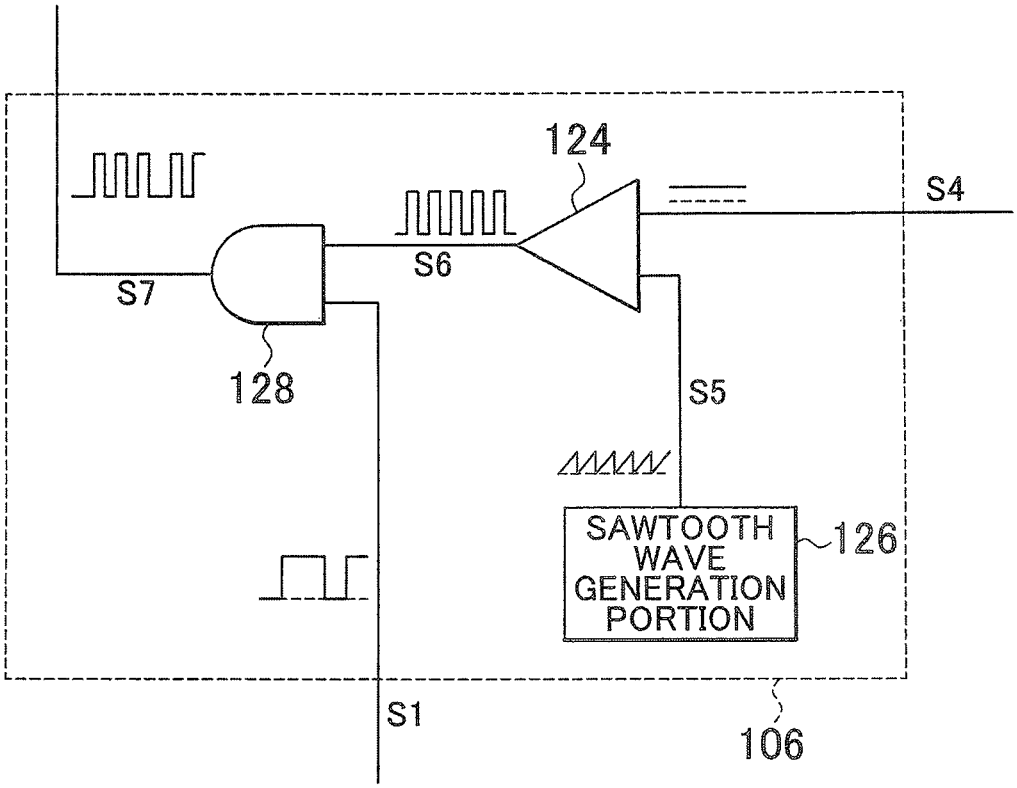
FIG. 2 is a circuit diagram showing a construction of a drive circuit shown in FIG. 1.

FIG. 2 is a circuit diagram showing a construction of the drive circuit 106. The drive circuit 106 has a PWM comparator 124, a sawtooth wave generation portion 126, and a second AND gate 128. The sawtooth wave generation portion 126 generates a sawtooth wave-shaped signal S5 whose voltage changes in a sawtooth manner at a switching frequency f2 of, for example, a several ten kHz to several hundred kHz, which is higher than the light dimming frequency f1, and outputs the sawtooth wave-shaped signal to the PWM comparator 124. The PWM comparator 124 compares the voltage of the sawtooth wave-shaped signal S5 and the analog voltage of the duty ratio setting signal S4, and generates a rectangular wave signal S6 that changes in voltage in a rectangular wave manner at the switching frequency f2 and that has a duty ratio commensurate with the analog voltage of the duty ratio setting signal S4. The rectangular wave signal S6 generated by the PWM comparator 124 and the PWM light dimming signal S1 are input to the second AND gate 128. The second AND gate 128 outputs a logical product of the two signals as an element control signal S7 to a control terminal of the switching element 122, that is, the gate thereof.

The element control signal S7 is a signal that is substantially the same as the rectangular wave signal S6 while the PWM light dimming signal S1 is asserted, that is, is at a high level, and that is negated while the PWM light dimming signal S1 is negated, that is, at a low level. Therefore, while the PWM light dimming signal S1 is asserted, the switching regulator 104 is in an active state, and while the PWM light dimming signal S1 is negated, the switching regulator 104 is in an inactive state.

Referring back to FIG. 1, the clock generation portion 110 generates a clock for the up/down counter 118. The clock generation portion 110 generates a pre-process clock signal S8 whose voltage changes in a rectangular wave manner at a clock frequency f3 of, for example, several ten kHz to several hundred kHz, which is higher than the light dimming frequency f1, and outputs the pre-process clock signal S8 to the first AND gate 108.

The pre-process clock signal S8 and the PWM light dimming signal S1 are input to the first AND gate 108. The first AND gate 108 outputs a logical product of the two signals as a post-process clock signal S3 to the clock pulse input terminal 118*b* of the up/down counter 118. In other words, the first AND gate 108 is a mask circuit that masks the pre-process clock signal S8 with the PWM light dimming signal S1 and that generates the post-process clock signal S3.

The post-process clock signal S3 is a signal that is substantially the same as the pre-process clock signal S8 while the PWM light dimming signal S1 is asserted, and that is negated while the PWM light dimming signal S1 is negated. Therefore, the up/down counter 118 performs the counting operation while the PWM light dimming signal S1 is asserted, and stops the counting operation when the PWM light dimming signal S1 is negated. While the PWM light dimming signal S1 is negated, the counting operation performed by the up/down counter 118 is stopped and the control digital value immediately before the stop of the counting operation is retained. In other words, the up/down counter 118 retains the control digital value at the time when the switching regulator 104 changes from the active state to the inactive state, until the next time the switching regulator 104 changes to the active state.

Figure 3:
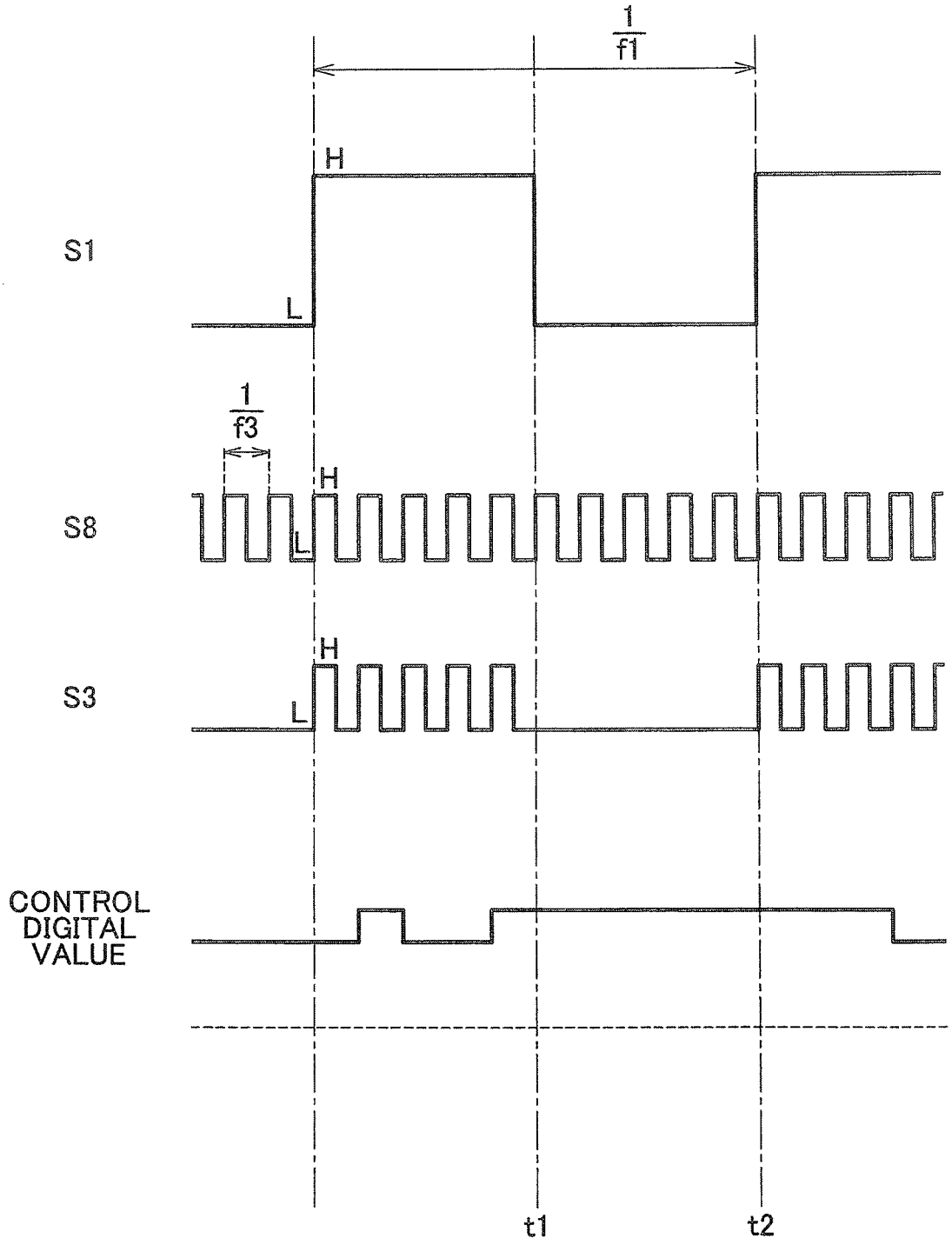
FIG. 3 is a time chart showing states of operation of a semiconductor light source lighting circuit shown in FIG. 1.

Operations of the semiconductor light source lighting circuit 100 constructed as described above will be described. FIG. 3 is a time chart showing states of operation of the semiconductor light source lighting circuit 100. FIG. 3 shows the voltage of the PWM light dimming signal S1, the voltage of the pre-process clock signal S8, the voltage of the post-process clock signal S3 and the magnitude of the control digital value in this order from above.

At time t1, the PWM light dimming signal S1 changes from a high level to a low level. Then, the post-process clock signal S3 having been the same clock signal as the pre-process clock signal S8 up to that time stops changing, and becomes constant at the low level. Along with the stop of changing of the post-process clock signal S3, the up/down counter 118 stops the counting operation. During the period from time t1 to time t2 during which PWM light dimming signal S1 is at the low level, the up/down counter 118 retains the control digital value at time t1.

When the PWM light dimming signal S1 changes from the low level to the high level at time t2, the up/down counter 118 starts the counting operation by using as a starting point the retained control digital value that is the value at time t1.

According to the semiconductor light source lighting circuit 100 in accordance with the embodiment, the PWM light dimming is realized by periodically changing the switching regulator 104 itself to the inactive state. Therefore, it is possible to restrain the magnitude of the current that flows through the LED when the off state is changed to the on state, in comparison with the case where, for example, a switch provided between the LED and the switching regulator 104 is switched between the off state and the on state to perform the PWM light dimming. In consequence, it is possible to use a more inexpensive element that is lower in electric withstanding voltage or withstanding current as an element of the semiconductor light source lighting circuit 100, and the efficiency of the semiconductor light source lighting circuit 100 is improved.

In the semiconductor light source lighting circuit 100 in accordance with the embodiment, since the control digital value is retained during the inactive state of the switching regulator 104, the drive currents $I_{LED}$ during the active states prior to and subsequent to the inactive state are smoothly connected with each other.

Besides, in the semiconductor light source lighting circuit 100 in accordance with the embodiment, the error amount is digitized as a control digital value. That is, the process for acquiring the duty ratio setting signal S4 from the detection voltage Vd is digitized by using the error comparator 116, the up/down counter 118, and the D/A converter 120. This eliminates the need to provide a relatively large-capacity capacitor or the like for retaining the error amount, and makes it possible to reduce the circuit size, in comparison with the case where such a process is carried out in an analog manner.

Besides, in the semiconductor light source lighting circuit 100 in accordance with the embodiment, the retaining of the error amount during the inactive state is realized simply by causing the up/down counter 118 to stop the counting operation. Therefore, it is possible to simplify the circuit construction and reduce the circuit size in comparison with the case where the error amount is retained in the analog manner.

During the inactive state, no current flows through the LED 40, and therefore the difference between the detection voltage Vd and the reference voltage Vref is larger than during the active state. However, in the semiconductor light source lighting circuit 100 in accordance with the embodiment, when the counting operation of the up/down counter 118 stops, the control digital value is retained regardless of the error signal S2. Therefore, there is no need to provide a special circuit or the like for processing the voltage difference that has increased as described above (Second Embodiment)

In the first embodiment, the engine control unit 20 generates the PWM light dimming signal S1, and supplies it to the semiconductor light source lighting circuit 100, and also supplies the semiconductor light source lighting circuit 100 with the input voltage Vin that is substantially constant regardless of the PWM light dimming signal S1. In this case, although not shown in FIG. 1, there generally arises a need to provide both the engine control unit 20 and the semiconductor light source lighting circuit 100 with interface circuits for sending and receiving the PWM light dimming signal S1. In the second embodiment, the use of the PWM light dimming signal S1 is not used, and the input voltage Vin is used instead to realize the PWM light dimming by turning the input voltage Vin on and off at the light dimming frequency f1. This makes it possible to omit one of the signal lines between the engine control unit and the semiconductor light source lighting circuit, and the need for interface circuits as mentioned above is eliminated.

When the input voltage Vin turns off, that is, becomes 0 V, the analog power source voltage and the digital power source voltage that the semiconductor light source lighting circuit produces from the input voltage Vin also decrease. If the error amount is digitized, the power source voltage needed to retain the error amount is less than that in the case where the error amount is retained in the analog manner. Therefore, the digitization of the error amount is more suitable in the case where the PWM light dimming is achieved by turning the input voltage Vin on and off.

Figure 4:
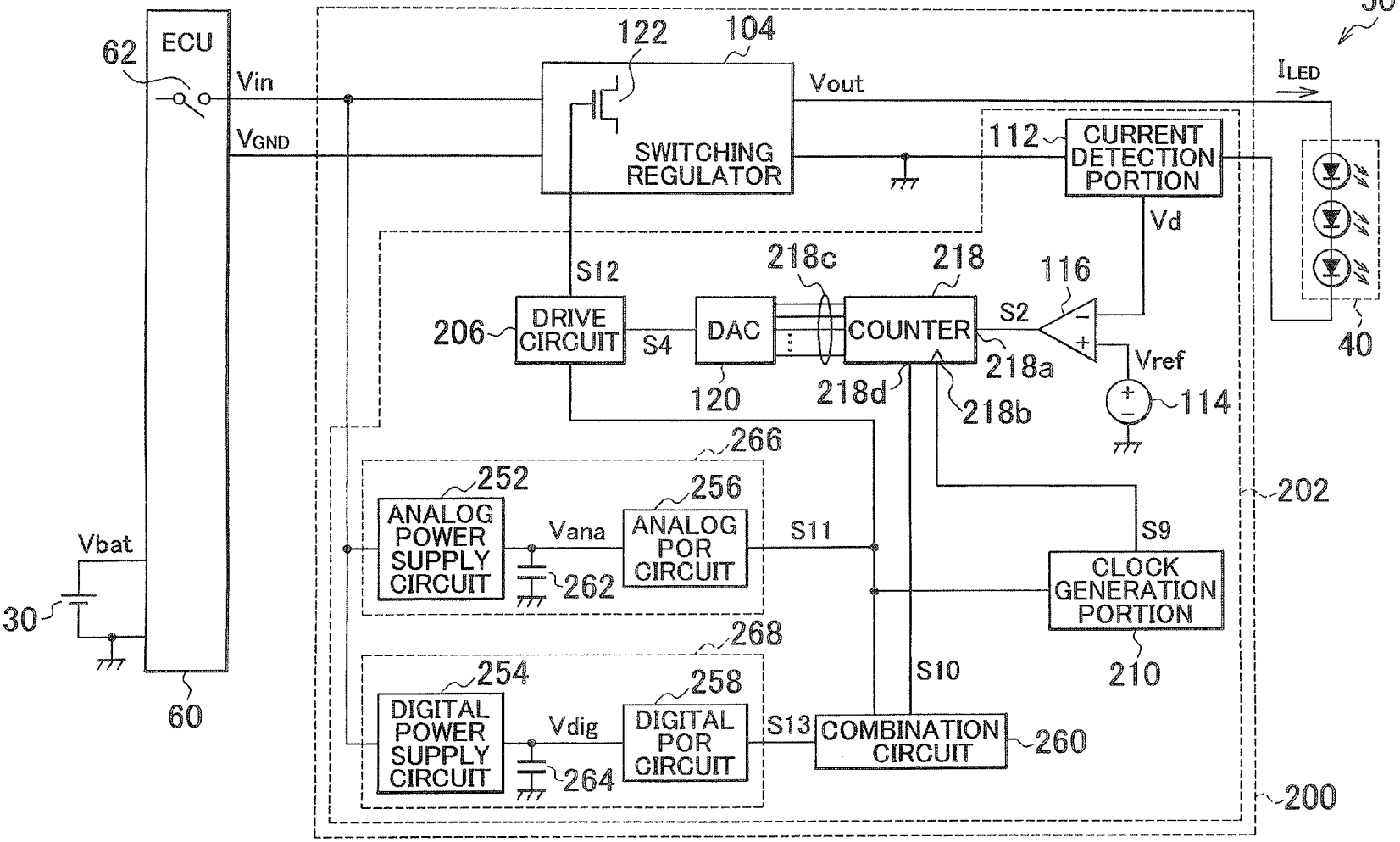
FIG. 4 is a circuit diagram showing a construction of a vehicle-mounted circuit in accordance with a second embodiment of the present invention.

FIG. 4 is a circuit diagram showing a construction of the vehicle-mounted circuit 50. The vehicle-mounted circuit 50 includes a semiconductor light source lighting circuit 200 in accordance with the second embodiment, an engine control unit 60, a vehicle-mounted battery 30, and an LED 40.

The engine control unit 60, by using a light-dimming switching element 62, produces an input voltage Vin that changes in a rectangular wave manner at a light dimming frequency f1. The duty ratio of the input voltage Vin is set in the same manner as that of the PWM light dimming signal S1. For example, the high level of the input voltage Vin is a battery voltage Vbat and the low level thereof is a ground potential. The engine control unit 60 supplies the produced input voltage Vin to the semiconductor light source lighting circuit 200.

The semiconductor light source lighting circuit 200 includes a control circuit 202 and a switching regulator 104. The control circuit 202 has a current detection portion 112, a reference voltage source 114, an error comparator 116, an up/down counter 218, a D/A converter 120, a drive circuit 206, a clock generation portion 210, an analog power supply portion 266, a digital power supply portion 268, and a combination circuit 260. The analog power supply portion 266 has an analog power supply circuit 252, an analog power-on-reset (POR) circuit 256, and an analog power supply-retaining capacitor 262. The digital power supply portion 268 has a digital power supply circuit 254, a digital POR circuit 258, and a digital power supply-retaining capacitor 264.

The switching regulator 104 produces a drive current $I_{LED}$ by using a switching element 122 while the input voltage Vin supplied by the engine control unit 60 is the battery voltage Vbat. The switching regulator 104 does not produce the drive current $I_{LED}$ while the input voltage Vin is the ground potential. Therefore, of the levels of the input voltage Vin, the battery voltage Vbat corresponds to the active state of the switching regulator 104, and the ground potential corresponds to the inactive state thereof.

The up/down counter 218 has an U/D control terminal 218*a* to which an error signal S2 is input, a clock pulse input terminal 218*b* to which a clock signal S9 is input, output terminals 218*c*, the number of which corresponds to the number of bits of a control digital value that is incremented and decremented, and a clear terminal 218*d* to which a combined POR signal S10 is input.

The up/down counter 218 performs the counting operation at the time of the transition of the clock signal S9 based on the error signal S2 in substantially the same manner as the up/down counter 118 in the first embodiment, except for the resetting/reset-canceling function by the combined POR signal S10. The up/down counter 218 is in the reset state while the combined POR signal S10 is negated. The reset state of the up/down counter 218 is canceled while the combined POR signal S10 is asserted. In the reset state, the up/down counter 218 is initialized, and the control digital value returns to an initial value.

Incidentally, the up/down counter 218 is constructed of an element that does not have a clear terminal, such as a 74-series '191, which is a standard logic IC, or the like, the combined POR signal S10 may be input to a load terminal, and all of data input terminals may be connected to the ground potential. In this case, if the combined POR signal S10 is negated, the control digital values are initialized to all zero.

The drive circuit 206 compares a sawtooth wave-shaped signal whose voltage changes in a sawtooth wave manner at the switching frequency f2 and the duty ratio setting signal S4, and generates an element control signal S12 that changes in voltage in a rectangular wave manner at the switching frequency f2 and that has a duty ratio commensurate with the analog voltage of the duty ratio setting signal S4. The drive circuit 206 outputs the generated element control signal S12 to the gate of the switching element 122.

The analog power supply circuit 252 produces an analog power source voltage Vana that is to be supplied to an analog element of the semiconductor light source lighting circuit 100, from the input voltage Vin supplied from the engine control unit 60. A set value of the analog power source voltage Vana is, for example, about 6 V. In particular, the analog power supply circuit 252 supplies the analog power source voltage Vana to the error comparator 116 and the drive circuit 206. An end of the analog power supply-retaining capacitor 262 is connected to an output stage of the analog power supply circuit 252, and the other end of the capacitor 262 is grounded.

The analog POR circuit 256 causes analog elements, including the drive circuit 206 and the error comparator 116, to be in a reset state, if the analog power source voltage Vana produced by the analog power supply circuit 252 is lower than a predetermined analog POR voltage. In the reset state, the state of the analog elements is initialized.

During a process in which the input voltage Vin rises from the ground potential to the battery voltage Vbat, the analog power source voltage Vana produced by the analog power supply circuit 252 also rises to the set value. However, a certain period of time is needed before the analog power source voltage Vana reaches the set value. If an analog element starts operating while the analog power source voltage Vana has not reached the set value, there is a possibility of the analog element failing to properly operate. Therefore, the analog POR circuit 256 cancels the reset state of the analog elements and causes the analog elements to operate, after the analog power source voltage Vana becomes equal to or higher than an analog POR voltage that is set a little lower than the set value. In this way, the certainty of the operation of the analog elements is increased.

Concretely, the analog POR circuit 256 generates an analog POR signal S11 that becomes a low level when the analog power source voltage Vana is lower than the analog POR voltage, and that becomes a high level when the analog power source voltage Vana is not lower than the analog POR voltage. The analog POR circuit 256 outputs the generated analog POR signal S11 to the analog elements, including the drive circuit 206 and the error comparator 116, and to the clock generation portion 210 and the combination circuit 260. The analog elements are constructed so as to become reset when the analog POR signal S11 is at the low level, and become released from the reset state when the analog POR signal S11 becomes the high level.

The digital power supply circuit 254 produces a digital power source voltage Vdig that is to be supplied to digital elements of the semiconductor light source lighting circuit 100, from the input voltage Vin supplied from the engine control unit 60. A set value of the digital power source voltage Vdig is, for example, about 3 V. In particular, the digital power supply circuit 254 supplies a digital power source voltage Vdig to the up/down counter 218. Generally, the digital power source voltage Vdig to be supplied to the up/down counter 218 is lower than the analog power source voltage Vana. However, these voltages are sometimes made equal, depending on the circuit design. Hereinafter, it is assumed that the analog power source voltage Vana is higher than the digital power source voltage Vdig.

The digital POR circuit 258 causes the digital element, including the up/down counter 218, to be in the reset state if the digital power source voltage Vdig produced by the digital power supply circuit 254 is lower than a predetermined digital POR voltage. In the reset state, the state of the digital elements is initialized. Since the set value of the analog power source voltage Vana is higher than the set value of the digital power source voltage Vdig, the analog POR voltage is set higher than the digital POR voltage. The digital POR circuit 258 causes the up/down counter 218 to be in the reset state via the combination circuit 260.

Concretely, the digital POR circuit 258 generates a digital POR signal S13 that becomes a low level when the digital power source voltage Vdig is lower than the digital POR voltage, and that becomes a high level when the digital power source voltage Vdig is not lower than the digital POR voltage. The digital POR circuit 258 outputs the generated digital POR signal S13 to the combination circuit 260 and the digital elements except the up/down counter 218. The digital elements other than the up/down counter 218 are constructed to be brought into the reset state when the digital POR signal S13 is at the low level, and to be released from the reset state when the signal S13 is at the high level.

The digital power supply portion 268 is constructed to generate a digital power source voltage Vdig that is equal to or higher than the digital POR voltage even when the input voltage Vin is equal to the ground potential during operation of the vehicle-mounted circuit 50. That is, an end of the digital power supply-retaining capacitor 264 is connected to an output stage of the digital power supply circuit 254, and the other end thereof is grounded. A capacity of the digital power supply-retaining capacitor 264 is selected so that the digital power supply circuit 254 can keep the value of the digital power source voltage Vdig equal to or higher than the digital POR voltage while the input voltage Vin is the ground potential. In this case, the digital POR signal S13 maintains the high level even while the input voltage Vin is the ground potential. That is, while the switching regulator 104 is in the inactive state, the digital elements, including the up/down counter 218, remain released from the reset state.

Figure 5:
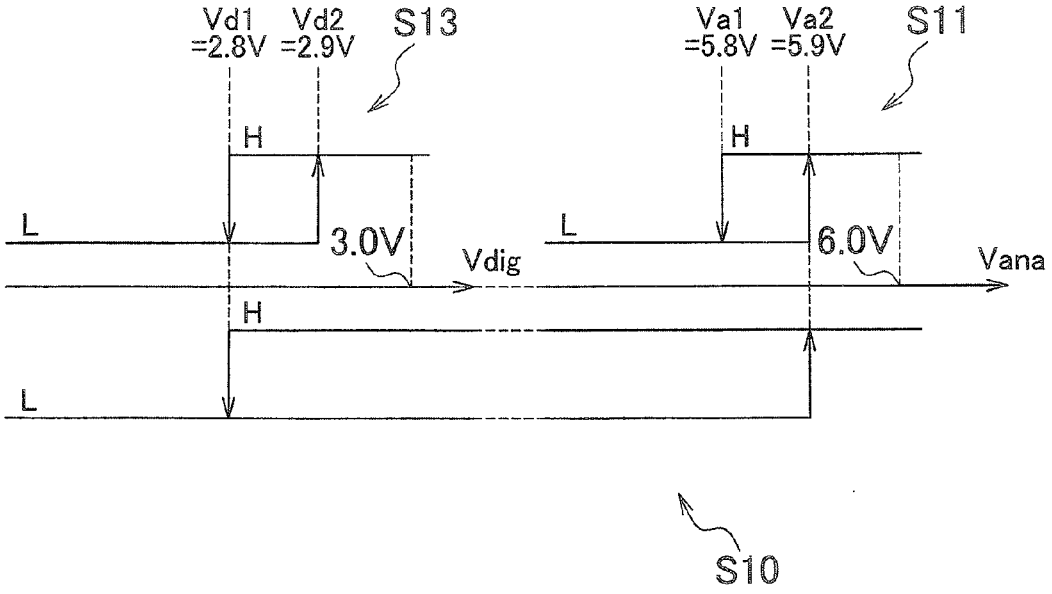
FIG. 5 is an illustrative diagram showing a relation among an analog PRO signal, a digital POR signal, and a combined POR signal shown in FIG. 4.

The combination circuit 260 generates a combined POR signal S10 that controls the resetting of the up/down counter 218, on the basis of the analog POR signal S11 and the digital POR signal S13. FIG. 5 is an illustrative diagram showing relations among the analog POR signal S11, the digital POR signal S13, and the combined POR signal S10. The horizontal axis in FIG. 5 shows the analog power source voltage Vana or the digital power source voltage Vdig.

The digital POR voltage of the digital POR signal S13 is arranged so as to have hysteresis, and has a first digital POR voltage Vd1 and a second digital POR voltage Vd2 that is higher than the first digital POR voltage Vd1. The digital POR signal S13 changes from a low level to a high level when the digital power source voltage Vdig exceeds the second digital POR voltage Vd2. When the digital power source voltage Vdig becomes lower than the first digital POR voltage Vd1, the digital POR signal S13 changes from the high level to the low level. Similarly, the analog POR voltage of the analog POR signal S11 is also arranged to have hysteresis, and has a first analog POR voltage Va1 and a second analog POR voltage Va2 that is higher than the first analog POR voltage Va1.

The combined POR signal S10 changes from a low level to a high level when the analog power source voltage Vana exceeds the second analog POR voltage Va2. When the digital power source voltage Vdig becomes lower than the first digital POR voltage Vd1, the combined POR signal S10 changes from the high level to the low level. The combination circuit 260 is constructed to generate the combined POR signal S10 as described above from the analog POR signal S11 and the digital POR signal S13, and to output the generated signal to the clear terminal 218*d* of the up/down counter 218.

Referring back to FIG. 4, the clock generation portion 210 generates the clock signal S9 whose voltage changes in a rectangular wave manner at a clock frequency f3 when the analog POR signal S11 is at the high level, and whose voltage becomes constant when the analog POR signal S11 is at the low level. The clock generation portion 210 outputs the clock signal S9 to a clock pulse input terminal 218*b* of the up/down counter 218.

While the input voltage Vin is the ground potential, the digital power supply portion 268 keeps the digital power source voltage Vdig higher than a set value, so that the digital POR signal S13 maintains the high level and the combined POR signal S10 also maintains the high level. Therefore, the up/down counter 218 continues to be supplied with the power source voltage, and is not reset. Furthermore, while the input voltage Vin is the ground potential, the clock signal S9 is constant at the low level and does not change, so that the up/down counter 218 stops the counting operation, and the control digital value immediately before the counting is stopped is retained.

Figure 6:
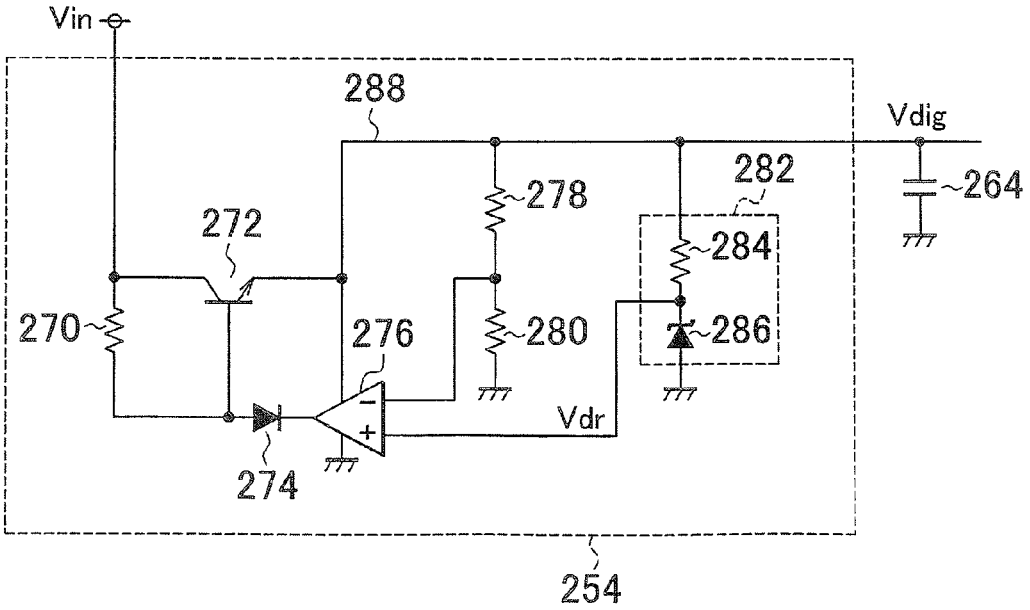
FIG. 6 is a circuit diagram showing a construction of a digital power supply circuit and a digital power supply-retaining capacitor shown in FIG. 4.

FIG. 6 is a circuit diagram showing a construction of the digital power supply circuit 254 and the digital power supply-retaining capacitor 264. The digital power supply circuit 254 has a first resistor 270, an npn type bipolar transistor 272, a diode 274, an operational amplifier 276, a second resistor 278, a third resistor 280, and a reference voltage generation circuit 282.

The input voltage Vin is applied to one end of the first resistor 270 and to the collector of the npn type bipolar transistor 272. The other end of the first resistor 270 and the base of the npn type bipolar transistor 272 are connected to the anode of the diode 274. The emitter of the npn type bipolar transistor 272 is connected to a bus line 288 that has the digital power source voltage Vdig. A power supply terminal of the operational amplifier 276, one end of the second resistor 278, one end of the reference voltage generation circuit 282, and one end of the digital power supply-retaining capacitor 264 are connected to the bus line 288. The other end of the second resistor 278 is connected to one end of the third resistor 280 and to inverting input terminal of the operational amplifier 276. The other end of the third resistor 280 is grounded. The reference voltage generation circuit 282 has a fourth resistor 284 and a Zener diode 286 that are connected in series. The anode of the Zener diode 286 is grounded, and one end of the fourth resistor 284 is connected to the bus line 288. A connection node between the other end of the fourth resistor 284 and the cathode of the Zener diode 286 is connected to the non-inverting input terminal of the operational amplifier 276. The output terminal of the operational amplifier 276 is connected to the cathode of the diode 274.

In the digital power supply circuit 254, when the input voltage Vin starts to rise from the ground potential, a substantially conducting state is established between the collector and the emitter of the npn type bipolar transistor 272, so that the input voltage Vin appears in the bus line 288. Thus, using the input voltage Vin that appears in the bus line 288, the reference voltage generation circuit 282 generates the digital power supply reference voltage Vdr. During the process of rise of the input voltage Vin, the digital power supply circuit 254 stabilizes the digital power source voltage Vdig at the set value on the basis of the digital power supply reference voltage Vdr.

Besides, the analog POR circuit 256 and the digital POR circuit 258 may use the digital power supply reference voltage Vdr as a reference for the voltage comparison. The reference voltage source 114 may use the digital power supply reference voltage Vdr to generate the reference voltage Vref. Besides, although the Zener diode 286 is used to produce the digital power supply reference voltage Vdr in the reference voltage generation circuit 282, the present invention is not limited to this configuration.

Figure 7:
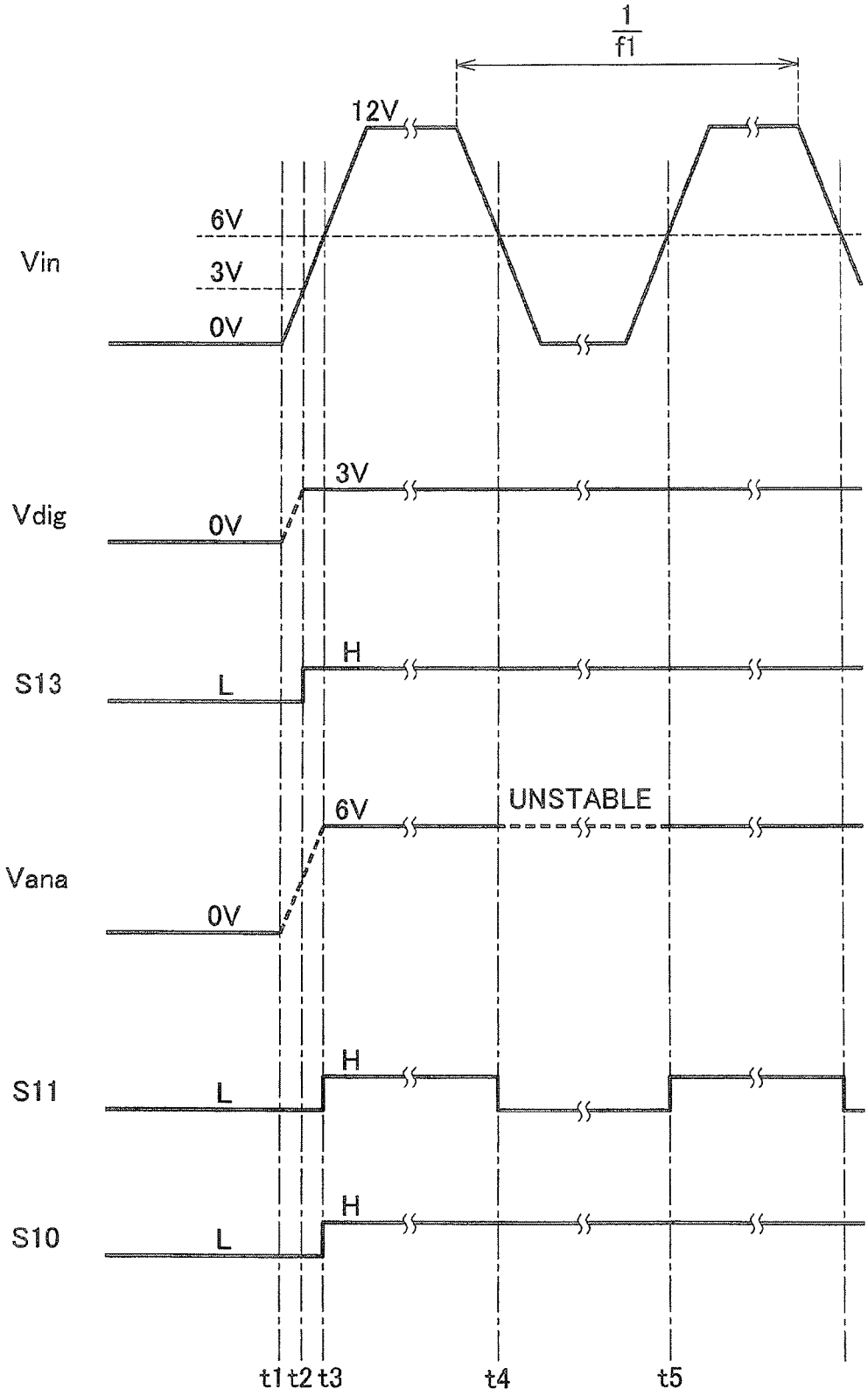
FIG. 7 is a time chart showing states of operation of a semiconductor light source lighting circuit shown in FIG. 4.

Operations of the semiconductor light source lighting circuit 200 constructed as described above will be described. FIG. 7 is a time chart showing states of operation of the semiconductor light source lighting circuit 200. FIG. 7 shows the input voltage Vin, the digital power source voltage Vdig, the voltage of the digital POR signal S13, the analog power source voltage Vana, the voltage of the analog POR signal S11, and the voltage of the combined POR signal S10, in this order from above. Hereinafter, to make the description easier to understand, a case where no hysteresis is set in the analog POR voltage and the digital POR voltage will be described. However, it is apparent to persons having ordinary skill in the art that the description of the case can be extended to the case where hysteresis is set as shown in FIG. 5.

When the vehicle-mounted circuit 50 is started at time t1, the input voltage Vin starts to rise from the ground potential toward the battery voltage Vbat that is about 12 V. At this time point, the digital power source voltage Vdig and the analog power source voltage Vana are lower than the digital POR voltage of about 3 V and the analog POR voltage of about 6V, respectively, so that the digital POR signal S13, the analog POR signal S11, and the combined POR signal S10 are all at the low level.

When the input voltage Vin exceeds about 3 V at time t2, the digital power source voltage Vdig having been unstable up to then is stabilized at a set value of about 3 V, and the digital POR signal S13 changes to the high level. However, due to the construction of the combination circuit 260, the combined POR signal S10 remains at the low level, and the up/down counter 218 remains in the reset state.

When the input voltage Vin exceeds about 6 V at time t3, the analog power source voltage Vana exceeds the analog POR voltage for the first time after time t1, and is stabilized at the set value of about 6 V. In accordance with this, the analog POR signal S11 and the combined POR signal S10 change to the high level. This releases the up/down counter 218 from the reset state, so that the counting operation of the control digital value starts.

When the input voltage Vin becomes lower than about 6 V during a process in which the input voltage Vin descends from about 12 V to the ground potential at time t4, the analog power source voltage Vana becomes unstable, and the analog POR signal S11 changes from the high level to the low level.

During the period from time t4 to time t5 at which the input voltage Vin subsequently exceeds 6 V, the digital power source voltage Vdig remains about 3 V due to the construction of the digital power supply portion 268. Furthermore, due to the construction of the combination circuit 260, the combined POR signal S10 remains the high level. During the period from time t4 to the time t5, the up/down counter 218 stops the counting operation of the control digital value in accordance with the stop of change of the clock signal S9. While the change of the clock signal S9 is stopped, the up/down counter 218 retains the control digital value at the time of the stop of the counting operation. When the clock signal S9 restarts changing at time t5, the up/down counter 218 restarts the counting operation of the control digital value in accordance with the restart of changing.

According to the semiconductor light source lighting circuit 200 in accordance with the embodiment, it is possible to efficiently realize, in a reduced circuit size, the retention of the error amount during the inactive state of the switching regulator 104 in a situation where the PWM light dimming is realized by the turning on and off of the input voltage Vin supplied from the engine control unit 60 to the semiconductor light source lighting circuit 200. That is, firstly, since the retention of the error amount is digitally carried out, the circuit size is reduced and the correctness of the error amount improves. Furthermore, the power supply is divided into the analog power supply portion 266 of an analog system and the digital power supply portion 268 of a digital system, and the digital power supply portion 268 of the digital system is provided with the digital power supply-retaining capacitor 264 for maintaining the digital power source voltage Vdig. Due to this construction, the retention of the error amount at the up/down counter 218 can be realized in a reduced circuit size.

In the case where the retention of the error amount is to be realized without dividing the power source voltage, the maintenance of the power supply for the up/down counter 218 requires that the power supply for many other analog elements be also maintained. However, generally, in order to maintain the power supply for an analog element, it is necessary to provide a power supply-retaining capacitor having a relatively large capacity, which may result in an increased circuit size. However, in the semiconductor light source lighting circuit 200 in accordance with the embodiment, it is not necessary to maintain the power supply for such an analog element, and therefore the capacity of the digital power supply-retaining capacitor 264 may be small. Furthermore, since the electric power consumption of the digital-system circuit is greatly reduced by the stop of the counter clock of the clock generation portion 210, it is possible to further reduce the capacity of the digital power supply-retaining capacitor 264 by a corresponding amount.

In general, the POR function discontinues the reset state of a circuit when the voltage reaches a normal range in relation to the highest voltage that the circuit needs (6V in the case where the voltage of the analog system is 6 V and the voltage of the digital system is 3 V), and resets the circuit to initialize the state of the circuit when the voltage becomes out of the normal range. However, if this is immediately applied, the up/down counter will be reset in the inactive state in which the error amount is desired to be retained in the up/down counter. Therefore, in the semiconductor light source lighting circuit 200 in accordance with the embodiment, the POR function is provided separately for each of the digital elements and the analog elements. This makes it possible to use the POR functions appropriate individually to the digital power supply system and the analog power supply system.

Besides, in the semiconductor light source lighting circuit 200 in accordance with the embodiment, immediately after the semiconductor light source lighting circuit 200 is activated, the up/down counter 218 is not caused to exit the reset state until the analog elements are released from the reset state. Furthermore, during operation, the up/down counter 218 is not reset by the POR function even in the inactive state. This makes it possible to prevent the up/down counter 218 from being released from the reset state while the state of the analog system is still unstable at the time of activation of the semiconductor light source lighting circuit 200, while realizing the retention of the error amount during the inactive state. In consequence, the correctness of the counting operation of the up/down counter 218 is improved.

The construction and the operations of the semiconductor light source lighting circuit in accordance with the embodiment have been described above. The foregoing embodiments and examples are merely illustrative, and it is to be understood by a person with ordinary skill in the art that various modifications are possible regarding combinations of various component elements and processes, and that such modifications are within the scope of the present invention.

Although the second embodiment has been described above in conjunction with the case where the counting operation of the up/down counter 218 is stopped in accordance with the stop of change of the clock signal S9, the present invention is not limited to this configuration. For example, the count enable terminal of the up/down counter may be used. In this case, a count enable signal that changes substantially in the same manner as the analog POR signal S11 may be input to the count enable terminal. The up/down counter may perform substantially the same counting operation as the up/down counter 118 in the first embodiment while the count enable signal is asserted, and may stop the counting operation of the control digital value when the count enable signal is negated.

Although the second embodiment has been described in conjunction with the case where the clock generation portion 210 generates the clock signal S9 according to the analog POR signal S11, the present invention is not limited to this configuration. For example, the input voltage Vin may be directly monitored, or the input current Iin input to the semiconductor light source lighting circuit 200 from the engine control unit 60 may be directly monitored.

Although the second embodiment has been described in conjunction with the case where the combination circuit 260 outputs the combined POR signal S10 to the up/down counter 218, the present invention is not limited to this configuration. For example, the combination circuit may output the combined POR signal S10 to a digital element that should be released from the reset state after the state of the analog elements becomes stable at the time of activating the vehicle-mounted circuit 50, in addition to outputting the combined POR signal S10 to the up/down counter 218.

In the second embodiment, in the case where the analog power source voltage and the digital power source voltage are set substantially equal to each other, the analog power supply circuit 252 and the analog power supply-retaining capacitor 262 may be omitted, and the analog power supply portion may receive the digital power source voltage Vdig, and may supply the digital power source voltage Vdig as an analog power source voltage to the analog elements via a switch. Besides, the analog POR circuit 256 may monitor the digital power source voltage Vdig and may generate the analog POR signal. Besides, the switch of the analog power supply portion may be turned off when the analog POR signal is at the low level.

What is claimed is:

1. A semiconductor light source lighting circuit comprising:

a switching regulator that includes a switching element and produces a drive current for driving the semiconductor light source by using the switching element; and a control circuit that is configured to control turning on and off of the switching element so that magnitude of the drive current approaches a target value, wherein the control circuit includes:

a comparator that compares the magnitude of the drive current and the target value;

an up/down counter that is configured to perform a counting operation, in which a digital value is incremented or decremented based on a result of comparison performed by the comparator and that is configured to stop the counting operation when the switching regulator is brought into an inactive state in which the drive current is not produced;

a digital/analog converter that converts the digital value into an analog signal; and a drive circuit that is configured to control the turning on and off of the switching element based on the analog signal; wherein the up/down counter is configured to stop the counting operation while the switching regulator is in the inactive state;

the control circuit further includes a first control power supply portion that produces a first power source voltage to be supplied to the up/down counter, from an input voltage that is input to the switching regulator and that repeatedly switches between a first voltage that corresponds to an active state of the switching regulator and a second voltage that corresponds to the inactive state, wherein the first control power supply portion is configured to produce the first power source voltage, even when the direct current voltage is the second voltage; and the up/down counter is configured to stop the counting operation while the direct current voltage is the second voltage; and the control circuit further includes a second control power supply portion that produces a second power source voltage to be supplied to at least one of the comparator and the drive circuit and substantially equal to or higher than the first power source voltage, from the input voltage that is input to the switching regulator;

the first control power supply portion is configured to cause the up/down counter to be in a reset state when the first power source voltage is lower than a predetermined first threshold voltage;

the second control power supply portion is configured to cause at least one of the comparator and the drive circuit to be in the reset state when the second power source voltage is lower than a second threshold voltage that is higher than the first threshold voltage; and the first control power supply portion is configured to produce the first power source voltage that is equal to or higher than the first threshold voltage even when the input voltage is the second voltage.

2. The semiconductor light source lighting circuit according to claim 1, wherein the control circuit is configured to release the up/down counter from the reset state when the second power source voltage exceeds the second threshold voltage for the first time after the semiconductor light source lighting circuit is activated.

* * * * *